OR 4,285,

United States Patent [19]

Chien

[11] 4,285,236

[45] Aug. 25, 1981

[54] ROTARY TORQUE AND RPM INDICATOR FOR OIL WELL DRILLING RIGS

[75] Inventor: Loring C. Chien, Houston, Tex.

[73] Assignee: Dresser Industries, Inc., Dallas, Tex.

[21] Appl. No.: 97,007

[22] Filed: Nov. 23, 1979

[51] Int. Cl.[3] ..... E21B 47/00

[52] U.S. Cl. ..... 73/151; 340/539

[58] Field of Search ..... 73/151, 133 R, 136 R, 73/136 A, 136 B, 136 C, 136 D; 175/40; 364/422; 340/855, 539; 455/106; 324/163, 166, 175, 178

[56] References Cited

U.S. PATENT DOCUMENTS

| | | | |
|---|---|---|---|
| Re. 28,436 | 6/1975 | Vitter, Jr. et al. | 73/151 |
| 3,664,184 | 5/1972 | Dyer | 73/136 A |
| 3,691,825 | 9/1972 | Dyer | 73/136 A |

*Primary Examiner*—Jerry W. Myracle

*Attorney, Agent, or Firm*—John N. Hazelwood; Barry E. Deutsch

[57] ABSTRACT

Monitoring the torque applied by the rotary table to the drill string and the RPM of the drill string is provided. An intermediate adapter is positioned between the drill Kelly and the rotary table. A strain gauge is attached to the intermediate adapter to measure torsional deformation and provide an indication of rotary torque. Transmission of torque data is accomplished by radio frequency transmission utilizing a transmitter on the intermediate adapter. A receiver is mounted to the side of the drill rig floor to receive and demodulate the torque signal. The intermediate adapter is rotating at the same rate as the drill string. Detection of the revolutions utilizing the changing R.F. field strength is accomplished at the edge of the drill rig platform or elsewhere with a stationary sensor which doubles as the torque receiver. A highly directional torque transmitter antenna mounted on the adapter is used with the major lobe lying parallel to the rig floor and perpendicular to the pipe. By detecting the envelope of the radio frequency field strength, each rotation is marked by a peak. This enables continuous torque and RPM monitoring.

4 Claims, 8 Drawing Figures

ROTARY TORQUE AND RPM INDICATOR FOR OIL WELL DRILLING RIGS

BACKGROUND OF THE INVENTION

The present invention relates in general to the art of drilling oil and gas wells and, more particularly, to the measurement of rotary torque and RPM for oil and gas drilling rigs.

In the drilling of oil and gas wells with rotary rigs, and, in particular, the drilling of deep wells, the drill pipe is subjected to considerable stress. The stress is imposed by the weight of the drill string, by the resistance of the strata to the rotation of the drill pipe and to the cutting action of the drill bit in the different strata. Care must be taken to control the amount of torque imposed on the drill string, otherwise twist-offs may occur which would result in expensive fishing jobs to retrieve the last portion of the drill string.

The measurement of rotary torque is used to observe pipe sticking, indicate bit wear and optimize drilling. The counting of total revolutions of the drill string can give wear-life data to help prevent failure while drilling. RPM, used with rotary torque, weight on bit and rate of penetration, can be used to calculate factors that give valuable drilling data. The present invention provides a system for the transmission of rotary torque and real time revolutions from the rotary table/Kelly combination of an oilfield or other rotary drilling rig. Real time revolutions allow the RPM to be calculated.

DESCRIPTION OF PRIOR ART

The prior art measurement of rotary torque and revolving speed utilizes two, usually separate, transducer systems. Rotations are sensed by proximity switches which are closed each revolution. This method is commonly used, however, the switches often get in the way of the driller. Another commonly used method is to use a take-off point in the rotary chain drive and an electrical tachometer-generator. This method has the drawbacks of having to scale the output voltage and/or frequency in order to determine true revolutions. Either method is commonly used by wiring the transducer to the readout mechanism. Rotary torque is often measured by means of tension measurement in the rotary drive chain, accessible only from beneath the rig floor and rotary table.

In U.S. Pat. No. 3,664,184 to Norman D. Dyer, patented May 23, 1972, a rotary torque indicator for well drilling apparatus is shown and described as follows. The device is used to indicate torque applied by the rotary table to the drill string during drilling of oil and gas wells. An intermediate adapter between the Kelly bushing and the rotary table in one embodiment has two parts. The lower part of the adapter includes a standard male square drive that fits into the square drive of the rotary table, and is thus rotated by the rotary table. The upper part of the adapter includes a female square drive arranged to receive the male square drive on the Kelly. The Kelly transmits torque from the adapter assembly to the drill pipe. The upper part is connected to the lower part by either hydraulic cylinders or by linkage with strain gauge. The upper part rotates with the lower part, but is moveable relative thereto to indicate relative torque between the upper and lower parts. An R.F. transmitter connected to the hydraulic cylinder or strain gauge provides a torque signal to a remote R.F. receiver. An alternative embodiment has a unitized adapter assembly. Still another alternative embodiment uses a torque sensor and R.F. transmitter directly on the Kelly drive bushing without utilization of an intermediate bushing.

In U.S. Pat. No. 3,691,825 to Norman D. Dyer, patented Sept. 19, 1972, a rotary torque indicator for well drilling apparatus is shown and described as follows. This device is used to indicate torque applied by the rotary table to the drill string during drilling of oil and gas wells. An intermediate adapter between the Kelly bushing and the rotary table in one embodiment has two parts. The lower part of the adapter includes a standard male square drive that fits into the square drive of the rotary table, and is thus rotated by the rotary table. The upper part of the adapter includes a female square drive arranged to receive the male square drive on the Kelly. The Kelly transmits torque from the adapter assembly to the drill pipe. The upper part is connected to the lower part by either hydraulic cylinders or by linkage with a strain gauge. The upper part rotates with the lower part, but is moveable relative thereto to indicate relative torque between the upper and lower parts. An R.F. transmitter connected to the hydraulic cylinder or strain gauge provides a torque signal to a remote R.F. receiver. An alternative embodiment has a unitized adapter assembly. Still another alternative embodiment uses a torque sensor and R.F. transmitter directly on the Kelly drive bushing without utilization of an intermediate bushing.

SUMMARY OF THE INVENTION

The present invention provides a system for measuring the rotary torque and RPM of a rotary drill string. An intermediate adapter is positioned between the Kelly and the rotary table. A strain gauge is attached to the intermediate adapter to measure torsional deformation and provide an indication of rotary torque. Transmission of torque data is accomplished by radio frequency transmission utilizing a transmitter on the intermediate adapter. A receiver is mounted to the side of the drill rig floor to receive and demodulate the torque signal. The intermediate adapter is rotating at the same rate as the drill string. Detection of revolutions of the drill string is accomplished at the edge of the drill rig platform or elsewhere with a stationary sensor which doubles as the torque receiver. A highly directional torque transmitter antenna mounted on the adapter is used with the major lobe parallel to the rig floor and perpendicular to the drill pipe. By detecting the envelope of the radio frequency field strength, each rotation is marked by a peak. This enables continuous torque and RPM monitoring. The foregoing and other features and advantages of the present invention will become apparent from a consideration of the following detailed description of the invention when taken in conjunction with the accompanying drawings.

DETAILED DESCRIPTION OF THE INVENTION

Figure 1:
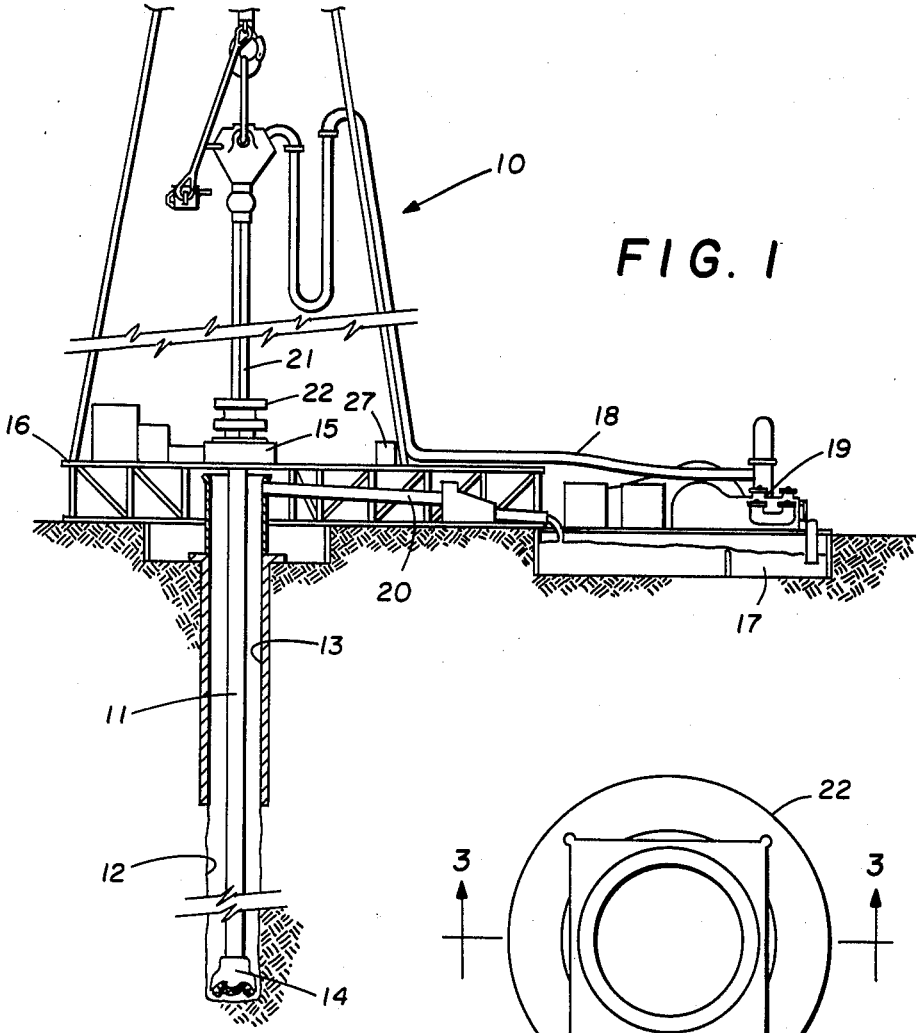
FIG. 1 is an illustration of one embodiment of the present invention incorporated in an oil well drilling rig.

Referring now to the drawings and, in particular, to FIG. 1, an embodiment of the present invention is illustrated in conjunction with an oil well drilling rig 10 and a rotary drill string 11 used in an oil well drilling operation. A well bore 12 is shown having a casing 13. The rotary drill string 11 is provided with a drill bit 14 at its lower end. The drill string 11 is rotated by a rotary table 15 mounted in the derrick 16. Drilling mud is pumped from a mud pit 17 through line 18 by pump 19. The mud is pumped into the drill string 11 and is discharged out of the bit 14 into the well bore 12. The mud continues upward in the well bore 12 and is returned from the top of the casing 13 by a mud flowline 20 to the mud pit 17. An openable and closeable blowout preventer or rotary drill head of any suitable conventional type is provided at the upper end of the casing 13.

Figure 2:
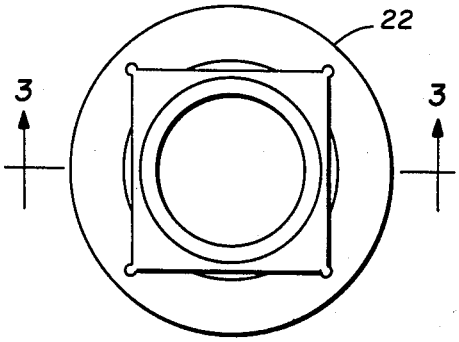
FIG. 2 is a top view of the intermediate adapter included in the equipment of FIG. 1.
Figure 3:
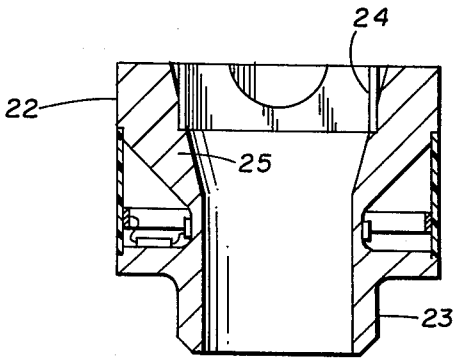
FIG. 3 is a sectional view taken along lines 3—3 of FIG. 2.

The drill string 11 is attached to the lower end of the drive Kelly 21. An intermediate adapter 22 is positioned between the Kelly 21 and the rotary table 15. Enlarged views of the intermediate adapter 22 are shown in FIGS. 2 and 3. The adapter 22 rotates with the drill string/Kelly combination and transmits all of the torque from the rotary table 15 to the Kelly 21. The mechanical portion is a one-piece adapter with one end 23 that fits into the square rotary table drive bushing. The other end 24 accepts the square shoulder of the Kelly drive. Between the two ends is a tubular section 25 that allows the Kelly 21 to pass through. The material and thickness of this tubular section 25 must be chosen so that the torque range transmitted through the adapter 22 is sufficient to achieve a measurable elastic strain deformation yet be totally safe from structural failure. This type of Kelly adapter is described in U.S. Pat. Nos. 3,664,184 and 3,691,825 by Norman Dyer.

For a one-piece adapter, a strain gauge torsional sensor is used. A two-piece unit engaged to compress a load cell may also be used to indicate torque, as described in the Dyer patents. Since all torque is transmitted through the adapter 22 calibration is independent of the rig it is installed in. This is an advantage over other types of sensors. Transmission of signals is accomplished by radio frequency telemetry, allowing maximum freedom from physical interconnections. Prior art methods of RPM and torque measurement require sensors mounted in physically inconvenient locations, i.e. under the drilling rig floor, and required semi-permanent wiring or hydraulic connections. Calibration of the prior art sensors is required and must be done on location where standards to calibrate against are frequently unavailable. The present invention allows easy installation at any time and is calibrated independently of the installation, so that calibration to a standard for torque is possible, and output in true revolutions can be determined without having to obtain ratios and scale factors as must now be done for prior art tachometer-generators commonly used.

Figure 4:
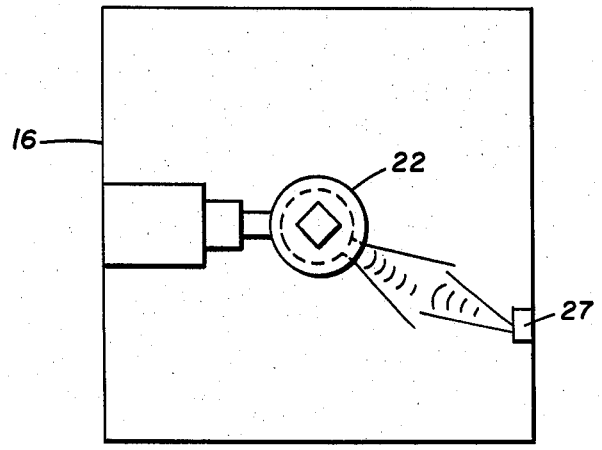
FIG. 4 is a view of the top of the rig floor of the illustration shown in FIG. 1.

The transmission of the torque and RPM information from the adapter 22 to a receiver 27 is illustrated in FIG. 4. A top view of the floor of the drilling rig 16 is illustrated. The analog strain value is converted to a frequency and the frequency is used to f-m modulate the carrier frequency. The radio frequency chosen is based on interference, regulations and acceptable antenna dimensions. The transmitter may be low powered since the usual distance to be transmitted is less than 100 feet. The receiver 27 mounted to the side of the drill rig floor will receive and demodulate the torque and RPM signal. Since the adapter 22 is rotating at the same rate as the drill string and rotary table, simultaneous torque detection and revolutions of the rotary table are obtained. The revolutions may be detected at the edge of the drill rig platform with a stationary sensor which doubles as the torque receiver. A highly directional torque transmitter antenna is mounted on the adapter with the major lobe lying parallel to the rig floor and perpendicular to the drill pipe. By detecting the envelope of the R.F. (radio frequency) field strength, each rotation is marked by a peak. This enables continuous torque and RPM monitoring.

Referring now to FIGS. 5-8, the torque sensor 28 and a wireless transmitter transmits the torque applied through the adapter 22. This may be accomplished utilizing 91.75 MHz commercially available FM transmitters, such as are available from Aerotherm Corporation. Higher frequencies, such as 217 MHz require more convenient antenna dimensions and are in frequency bands allocated for such service.

Figure 5:
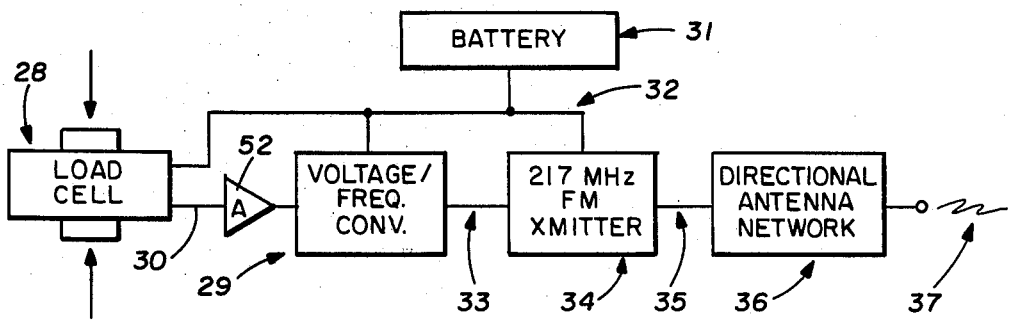
FIGS. 5-8 are circuit diagrams of components of a system constructed in accordance with the present invention.
Figure 6:
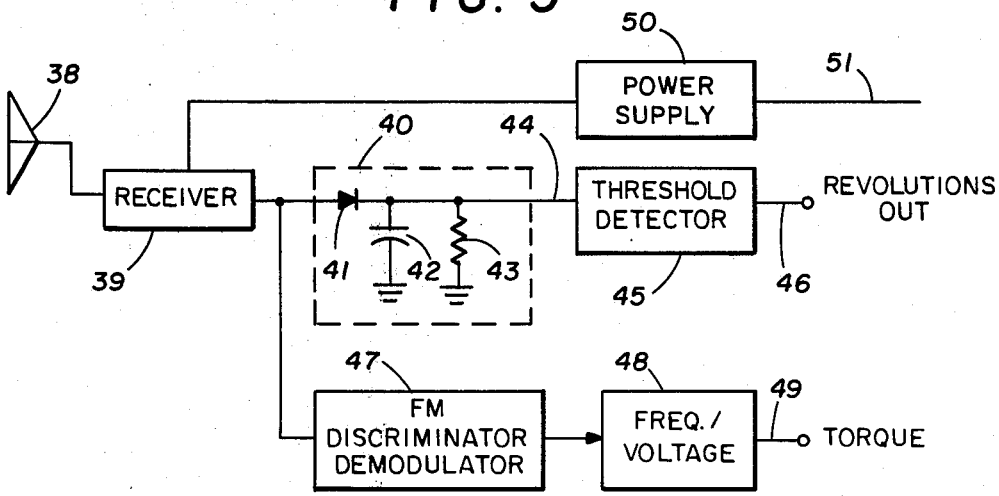

FIG. 6 shows the associated receiver for the transmitter of FIG. 5. The operation is as follows: Battery power source 31 powers all active components of the torque transmitter of FIG. 5. Load cell 28, which may also be a strain bridge or other device to determine torque as described in the Dyer patent, is amplified by amplifier 52, which may be commercially available or built from integrated circuit op amps such as Fairchild μA725. A frequency-to-voltage converter 29, such as may be built with Raytheon Semiconductor's RC4151 converts the torque voltage signal to an equivalent frequency, i.e., in the range of 0-10,000 Hertz. The 217 MHz FM transmitter 34, similar in function to "FM Wireless Mike", Markus, *Sourcebook of Electronic Circuits* 1968, p. 802 is used to transmit the frequency signal 33 through the directional antenna 36. This antenna is arranged so that one or more of its directional lobes lie in a plane parallel to the rig floor and perpendicular to the drill string. In this manner, the lobes will sweep over the rig floor once each revolution of the Kelly/-drill string assembly. An example of a one-lobe antenna is the well-known dish-type antenna; a simple horizontal centerfed dipole has two lobes.

The block diagram of the receiver is shown in FIG. 6. Its directional antenna 38 is pointed toward the drill string/Kelly assembly. FM discriminator/demodulator 47 converts the torque data back to a frequency; then frequency-to-voltage converter 48 (utilizing an RC4151) converts the frequency to analog torque at line 49. Alternately, a counter and time base can digitize torque. Envelope detector 40, which consists of a semiconductor diode 41, filter capacitor 42, and decay resistor 43, follows the envelope of the R.F. signal giving an indication of strength. The RC time constant should be larger than the modulation period, but much less than the fastest expected rotating period of the Kelly. A threshold detector 45, which may consist of an integrated circuit op amp wired as a D.C. comparator, can detect each R.F. signal strength period. For good noise immunity, a Schmitt trigger should be used, and the trigger level set by the relative average signal strength. If the Kelly transmitter antenna has more than one lobe, then there will be one output pulse per lobe per revolution. The combination of FIGS. 5 and 6 provide a system which receives torque data continuously, and has a logic output at every revolution.

Modifications may be made to the above described system without departing from the invention. For example, an AGC (automatic gain control) may be utilized using National Semiconductor's LM 370 to hold the peak R.F. envelope to a fixed value. The comparator threshold could be fixed and would require little or no adjustment. This would also enable the FM discriminator to have an adequate signal to process.

Figure 7:
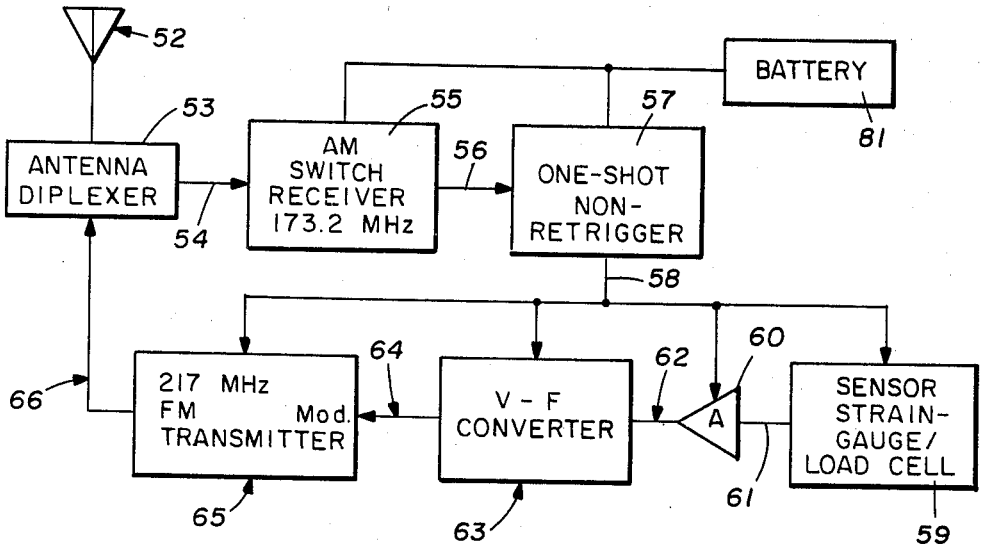
Figure 8:
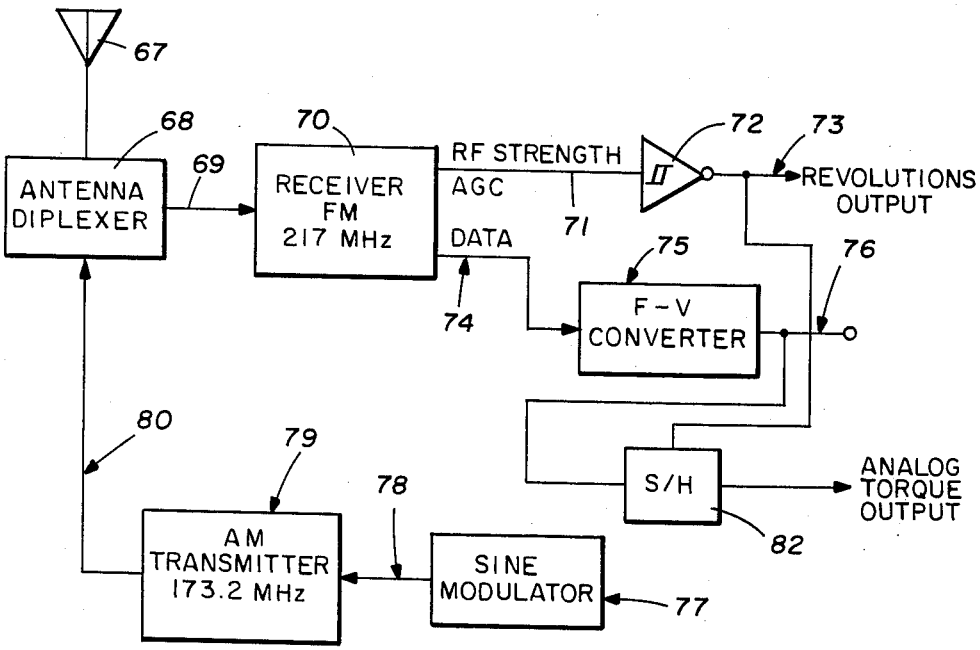

Another embodiment will be described that has the advantages of requiring less battery energy in the Kelly electronics. This reduces either the battery size or the required service interval. The block diagram for this system is shown in FIGS. 7 and 8 showing the Kelly package and the fixed rig-mounted package. Antennas 52 and 67 are highly directional one lobe antennas, aimed in the same manner as the previously described embodiment so that they achieve maximum gain relative to each other once per revolution. The torque receiver is shown in FIG. 8. It contains a transmitter at a different frequency (i.e. 173.2 MHz) than the torque data transmitter. It is continuously modulated in an amplitude modulation scheme by a signal generator 77, driving AM transmitter 79. A diplexer 68 allows antenna 67 to both receive torque data through line 69 and transmit trigger signal through line 80 at 173.2 MHz.

The Kelly unit has a low power receiver 55 which is tuned to 173.2 MHz and has a band-pass filter tuned to the periodic generator 77 in the data receiver's transmitter. When the 173.2 MHz signal exceeds a threshold, the receiver "switches", firing a one-shot unit 57, this switching action may be accomplished by a preset trigger threshold or by a dynamic threshold which follows the average level of the input R.F. signal and thus discriminates against noise.

Upon switching, one shot unit 57 powers the sensor 59 which may be a strain gauge or load cell, signal amplifier and conditioner 60, voltage-to-frequency converter 63 and FM transmitter 65. The action of these components is the same as components to 28, 52, 29, 34, 36 of FIG. 5 described previously. The FM modulated signal carries data information and is transmitted through antenna diplexer coupler 53 which allows use of antenna 52 for both transmitting and receiving.

When the FM receiver 70 shown in FIG. 8 detects a signal, two things happen. The receiver AGC (automatic gain control) changes to indicate the relative field strength. This action may be "cleaned" to a good logic signal by Schmitt trigger 72, similar to Motorola Semiconductors MC14093. Thus since there is data transmission once each revolution of the Kelly, the antennas couple once and there is one 217 MHz transmission. Thus each logic output of Schmitt trigger 72 indicates one revolution.

The data is derived as a frequency signal proportional to torque by the receiver's FM discriminator. An F-V converter 75 converts it to an analog signal, or a digital counter and time base can convert it easily to a digital value. Since the value only exists while being transmitted, a memory device is required to hold the last value. This may be a sample-and-hold device 82 triggered by the revolution output on line 73 to hold the data after that. A digital memory may be used and will have more ideal memory. Wherever a revolution signal 73 is detected, the memory should be refreshed by the current R.F. torque data being transmitted from the Kelly.

The 173.2 MHz R.F. interrogation signal is on continuously. The directional Kelly antenna sees a peak every revolution when the antenna radiation patterns couple. The switch receiver puts out a series of pulses, one for each peak in the interrogation signal. Finally, the 217 MHz bursts are seen by the torque receiver. The length of the burst is long enough so that the V-F unit 63 can settle to a specific accuracy, but short enough to conserve battery power and only be on while the antennas remain coupled by their position.

It would also be possible to provide an antenna system mounted in the Kelly so that its phase angle would be constantly changing relative to the receiver. The receiver would monitor the phase cancellations and reinforcements and determine the occurrence of each revolution. It is also possible to monitor revolutions only, by not modulating the R.F. signal from the Kelly assembly. In this case, the Kelly adapter is not necessary and the electronics (transmitter and antenna) may be mounted directly to the Kelly or Kelly bushing. From indications of each rotation, conventional rate meters may be used to indicate rotary rate in RPM. Such meters may be a SWACO Div. of Dresser Industries Combination Pump Stroke Rate Meter/Counter, which has the capability of determining RPM of an input signal closure rate.

The embodiments of the invention in which an exclusive property of privilege is described are defined as follows:

1. In a rotary drilling rig having a rotary drilling string of the type employed in the rotary method of drilling wells, the improvement comprising:

first transmitting means mounted at a fixed location on said drilling rig for continuously transmitting a first modulated signal;

receiving means mounted on the drilling string for receiving said modulated signal;

electronic switch means connected to said receiving means and periodically placed in an On state when the magnitude of the modulated signal exceeds a predetermined level;

second transmitting means mounted on said drilling string and activated in response to said switch means being placed in an On state to periodically transmit a signal; and receiving means mounted at a fixed location on said drilling rig for receiving said periodic signal, with the number of pulses of said signal being indicative of the RPM of said drilling string.

2. In the rotary drilling string of claim 1 further including:

sensor means connected to said drilling string for measuring torque of said string, said sensor means being activated in response to said switch means to modulate said periodic signal; and said fixed location receiving means including converting means for determining the sensed torque of said drilling string.

3. A torque and rotary revolution monitoring system for a drilling rig, comprising:

a housing;

a sensor for measuring torque connected to a Kelly or Kelly bushing or drill string or an adapter between a rotary table and Kelly bushing;

an R.F. transmitter in a housing connected to said sensor whereby the output of said transmitter is indicative of measured torque; and a receiver means spaced from said housing for receiving said output of said transmitter indicating torque and rotational properties of said radio signal for determining RPM.

4. A torque and RPM indicating system for a drilling rig, comprising:

a housing;

sensor means mounted in said housing for measuring torque;

an R.F. transmitter mounted in said housing, the input of said transmitter being driven by said sensor means whereby the output of said transmitter is indicative of the measured torque; and a receiver means spaced from said housing for receiving said output of said transmitter indicating torque and for determining RPM.

* * * * *